US006197179B1

(12) United States Patent
Arlt et al.

(10) Patent No.: US 6,197,179 B1
(45) **Date of Patent: *Mar. 6, 2001**

(54) PULSE-MODULATED DC ELECTROCHEMICAL COATING PROCESS AND APPARATUS

(75) Inventors: Klaus Arlt, Senden; Karin Eckert, Steinfurt; Margaret Stockbrink, Münster; Rolf Schulte, Havixbeck; Harald Berlin, Nottuln; Gerd Nienhaus, Münster, all of (DE)

(73) Assignee: BASF Coatings AG, Muenster-Hiltrup (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/894,074

(22) PCT Filed: Jan. 15, 1996

(86) PCT No.: PCT/EP96/00138

§ 371 Date: Sep. 17, 1997

§ 102(e) Date: Sep. 17, 1997

(87) PCT Pub. No.: WO96/23090

PCT Pub. Date: Aug. 1, 1996

(30) Foreign Application Priority Data

Jan. 27, 1995 (DE) ..... 195 02 470

(51) Int. Cl.[7] ..... C25D 13/18

(52) U.S. Cl. ..... 205/108; 204/229.5; 204/229.7; 204/471; 204/477; 204/499; 204/DIG. 8; 205/317

(58) Field of Search ..... 205/102–108, 205/317; 204/228, DIG. 8, 489, 499, 471, 477, 229.5, 229.7, 229.3

(56) References Cited

U.S. PATENT DOCUMENTS

| | | | | |
|---|---|---|---|---|
| 3,579,769 | * | 5/1971 | Matsushita | 29/25.42 |
| 3,616,434 | * | 10/1971 | Hausner | 204/229.5 |
| 3,702,813 | | 11/1972 | Tanaka et al. | 204/477 |
| 3,971,708 | * | 7/1976 | Davis et al. | 204/472 |
| 4,414,077 | * | 11/1983 | Yoshida et al. | 205/105 |
| 4,468,293 | * | 8/1984 | Polan et al. | 428/612 |
| 4,478,689 | * | 10/1984 | Loch | 205/83 |
| 5,328,580 | * | 7/1994 | Reamey | 204/484 |
| 5,550,104 | * | 8/1996 | Bhattacharya | 505/472 |

FOREIGN PATENT DOCUMENTS

| | | |
|---|---|---|
| 1534494 | 7/1968 | (FR) . |
| 1251808 | 9/1968 | (GB) . |

OTHER PUBLICATIONS

H. Silman et al. Protective and Decorative Coatings for Metals, Finishing Publications Ltd., Teddington, Middlesex, England, pp. 366–367, 1978 Month not Available.*

* cited by examiner

*Primary Examiner*—Kathryn Gorgos
*Assistant Examiner*—William T. Leader

(57) ABSTRACT

The present invention relates to a novel process for coating objects by means of direct current, in which process an adjustable DC voltage is pulse-modulated with an adjustable AC voltage. The process is useful for electrochemical coating of objects with resinous coating material. Preferably, the pulse modulation of the DC voltage is limited to certain time intervals during the coating process and the pulse modulation is connected and disconnected with an adjustable duty ratio.

13 Claims, 5 Drawing Sheets

PULSE-MODULATED DC ELECTROCHEMICAL COATING PROCESS AND APPARATUS

FIELD OF THE INVENTION

The present invention relates to a process and an apparatus for coating objects by means of direct current.

BACKGROUND AND SUMMARY OF THE INVENTION

Processes for depositing layers on objects by means of a voltage which pulsates to a greater or lesser extent are known from the prior art. For example, unregulated voltage spikes in the microsecond range are produced by means of thyristor-controlled rectifiers. These voltage spikes are pure interference pulses and are not used as a reproducible method for influencing the deposition result. Furthermore, the following disadvantages are symptomatic of working with poorly smoothed thyristor rectifiers.

1. Spark formation even under the coating surface on the sheet-metal surface to be coated.
2. Severe electrolysis.
3. Film thickness reduction.
4. Formation of flakes in the foam layer and on the sheet-metal edges.
5. After production of a breakdown, a greater reduction in voltage is required in order to reliably avoid this phenomenon with the next part to be coated.

From Brown, William B. (Journal of Paint Technology Vol. 47, No. 605, June 1975), it is known for a square pulse shape in the region of seconds to be produced by interrupting (disconnecting) the deposition current. This procedure has a number of disadvantages. For example, the specified pulse durations are in the region of seconds, preferably up to 3–20 seconds. In these relatively long pauses, on the one hand, the heat is dissipated and, in consequence, the layer resistance is increased. On the other hand, a redissolving effect also occurs, and in addition a softening of the deposited film and removal of gas bubbles as a result of the coating flow. This results in a reduction in the film resistance.

The reduction in the heat developed and in the peak current must in this case take place by slowly raising the voltage. Specifically, if one starts with a pulsed square-wave voltage at the full coating voltage immediately, then the rating of the rectifier must be more than doubled. This increases, in particular, the costs for the rectifier.

Furthermore, the currently available rectifier generators have considerable disadvantages. Specifically, depending on the type, they have a residual ripple which depends on the nature and quality of the rectification and smoothing of the input AC voltage (cf. Vincent, Journal of Coatings Technology Vol. 62, No. 785, June 1990). In addition, this residual ripple is load-dependent, that is to say feedback takes place via the coating process itself. This residual ripple is then also evident only as interference.

From T. Ito and K. Shibuya, Metal Finishing, April 1967, pages 48–57, "Anodic Behavior in Electrophoretic Coating of Aluminum Alloys", it is known for pulsed signals to be produced by alternating current that has been smoothed more or less poorly. Furthermore, processes using alternating-current deposition are known from the German Laid Open Specification 1646130 and the British Patent Application 1376761. In this case, anode plates are used as rectifiers. The anode plates pass current in only one direction, because of special coating.

However, to date, all the described processes have considerable defects. In particular, the breakdown behavior, throwing power, film thickness and film defects are, for example, dependent, inter alia, on the magnitude of the voltage in electro-dipping. In practice, this voltage is normally chosen such that an adequate level of cavity coating is achieved, with the minimum necessary external film thickness, in an acceptable coating time. In order to save coating material, and thus cost, when coating, efforts are made, inter alia, to achieve adequate throwing power with reduced external film thicknesses. With present products and the present technique described above, this development is subject to limits.

The present invention is accordingly based on the object of providing an apparatus for electrochemical coating of objects, by means of which the coating film characteristics and the application characteristics can be influenced systematically in order to obtain, for example, adequate throwing power with reduced external film thicknesses, or in order to achieve preliminary cross-linking during application.

This object is achieved in that an adjustable DC voltage is pulse-modulated by superimposing adjustable AC voltage components on it.

The adjustable AC voltage components are in this case preferably produced from cyclic signals, in particular harmonic oscillations (sinusoidal oscillations), which are easily available.

According to the invention, it is in this case possible by means of suitable circuits to subject the cyclic signals to preprocessing, preferably blocking of the negative voltage elements or rectification.

The invention furthermore provides for the capability to connect and disconnect the superimposition of the AC voltage components on the DC voltage with an adjustable duty ratio. In this way, the pulse modulation, as a variation of the conventional coating process using pure direct current, can be limited to specific time intervals during coating, for example at the start or at the end.

The ranges between 10:1 and 1:10 are known as preferred on:off duty ratios. The duration of the "on" period, in which pulse modulation takes place, is in this case between 10 ms and 100 s.

The DC voltages used according to the invention are in the range from 0 to 500 V. The AC voltage components used for superimposition are likewise between 0 and 500 V. In this case, the superimposition is carried out such that the resultant voltage does not change its direction, that is to say said voltage is a pulse-modulated DC voltage. The apparatus according to the invention is, however, not limited to this, so that it is invariably also possible to operate with a resultant AC voltage, if this provides advantages.

The cycle duration of the cyclic AC voltage components used for superimposition is, according to the invention, between 1 and 500 ms. This corresponds to a frequency of 1000 to 2 Hz. A frequency is preferably used which is obtained from the mains voltage, that is to say, for example, 50 Hz or a multiple of it.

There are various possibilities for producing a pulse-modulated DC voltage according to the invention.

One variant is to connect an AC (variable) transformer in series with a DC generator.

It is likewise possible to couple the AC (variable) transformer via a rectifier, so that a rectified AC voltage is introduced. If a diode is in this case connected between the alternating-current source and the input of the rectifier, further modulation of the voltage is achieved in such a way that only the positive or only the negative half-cycles reach the rectifier.

The optional use of pulse modulation can be carried out such that the AC voltage components are introduced via a mechanical or electronic relay. The latter may be driven via a function generator (that is to say with low current) in order to achieve a defined duty ratio.

A further variant for producing a pulse-modulated DC voltage according to the invention is obtained by connecting a function generator to the phase-gating controller of a three-phase rectifier. This saves the cost and space requirement for an additional AC generator. The function generator may be a commercially available electronic device. It is preferably a programmable microprocessor system, in particular preferably a computer having appropriate software, having an analog/digital converter for receiving the control voltage, and having an output unit for the trigger pulses.

One preferred application of the apparatus according to the invention is for electro-dipping. In this case, the amount of coating deposited in the processing time is directly dependent on the amount of charge which flows—and thus indirectly on the immersion voltage. It must be noticed that a gas layer, which can break down the current flow, occurs at the so-called breakdown voltage, as a result of heating and boiling processes. It is furthermore important to obtain a uniform and adequate film thickness of the coating even at inaccessible points, that is to say an adequate throwing power with reduced external film thicknesses. The process according to the invention surprisingly achieves an optimized result with respect to these requirements, some of which are contradictory.

BRIEF DESCRIPTION OF THE DRAWINGS

The invention will be explained in more detail in the following text with reference to the figures wherein.

DESCRIPTION

Figure 1:
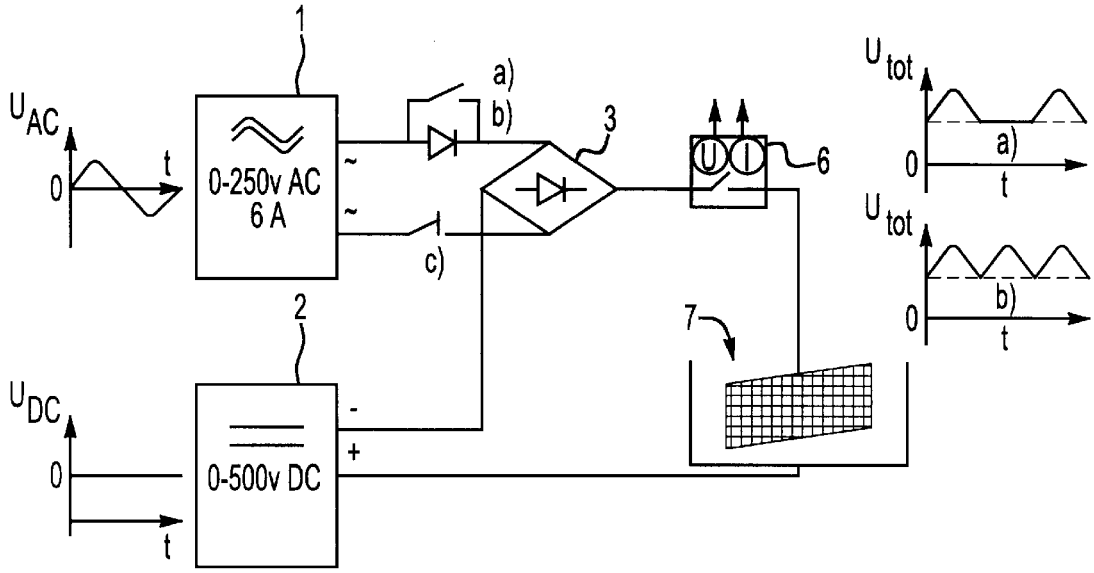
FIG. 1 is a schematic view of an apparatus for coating objects according to a first embodiment.

FIG. 1 shows the DC generator 2 and the DC-decoupled AC variable transformer 1. According to FIG. 1, the coupling, which can optionally be switched on and off via a switch c, takes place via the rectifier 3. Depending on whether the diode b is or is not bridging the switch a, all the half-cycles or only the positive half-cycles are rectified by the rectifier. The respectively resultant pulse-modulated voltage is illustrated in FIG. 1 in Diagram a) (switch a open) and b) (switch a closed, diode bridged). The instantaneous values of the current and voltage can be detected and monitored by a measuring system 6. The electro-dipping bath is denoted by the number 7.

Figure 2:
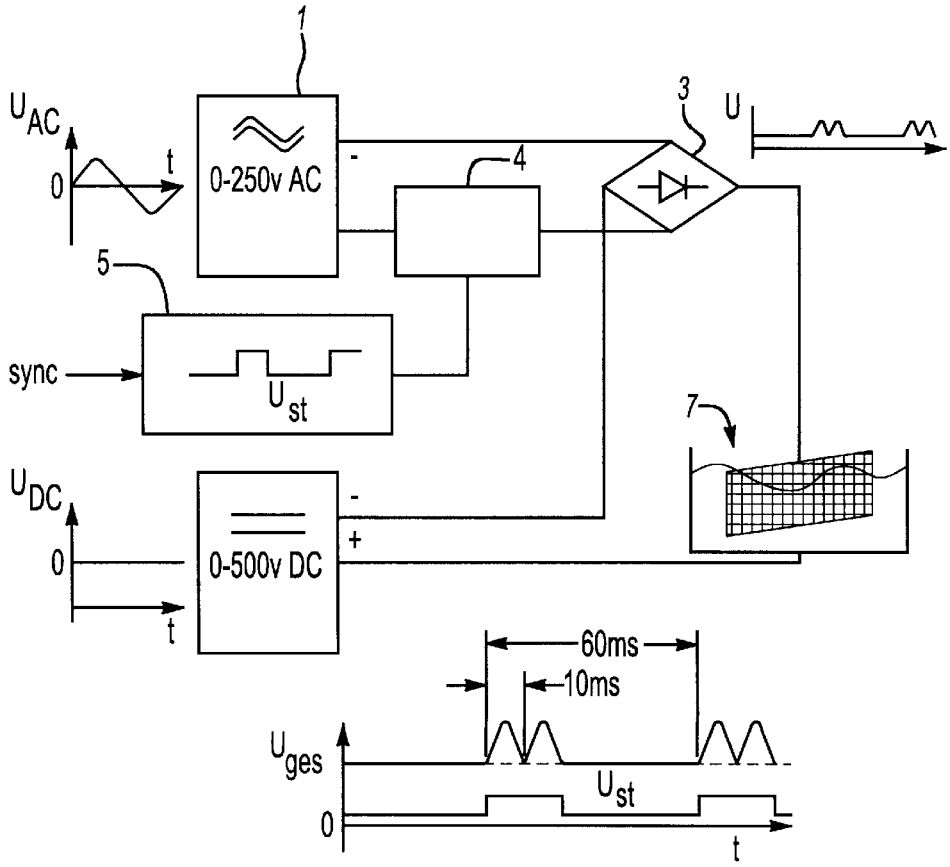
FIG. 2 is a schematic view of an apparatus for coating objects according to a second embodiment.

FIG. 2 shows a variant of the circuit from FIG. 1, in which, instead of the elements a, b and c, there is a semiconductor relay 4 between the variable transformer 1 and the rectifier 3. This semiconductor relay 4 is controlled by a function generator 5. The pulse modulation is in this way switched on and off with a defined duty ratio. Diagram a) at the lower edge of FIG. 2 shows schematically the resultant pulse-modulated voltage $U_{tot}$ as a function of the signal $U_{St}$ of the function generator.

Figure 3:
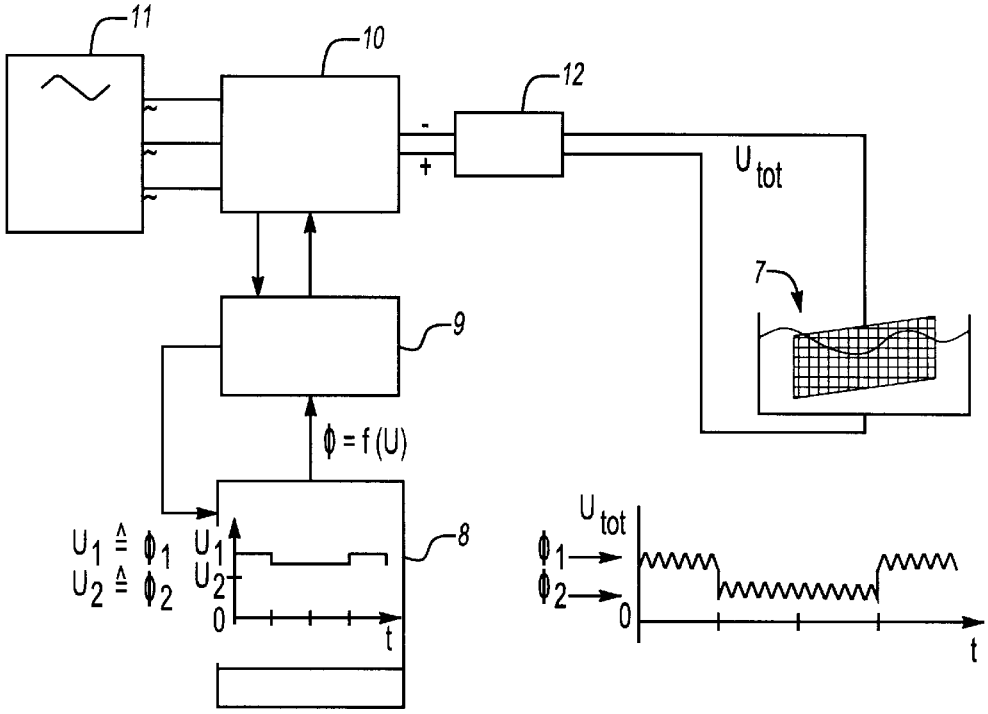
FIG. 3 is a schematic view of an apparatus for coating objects according to a third embodiment.

FIG. 3 shows a circuit in which the function generator 8 acts on the phase-gating controller 9 of a thyristor bridge rectifier 10 for a three-phase source 11. This results in cyclic switching between two phase angles $F_1$ and $F_2$, which correspond to two output voltages $U_1$ and $U_2$. The pulses then have the shape shown in Diagram 3*a* of smoothed three-phase pulses with two voltage levels. The residual ripple on the signals can be varied by the design of the smoothing device 12. This circuit arrangement also makes it possible, of course, to switch over, via the function generator, between more than two voltage levels.

Figure 4:
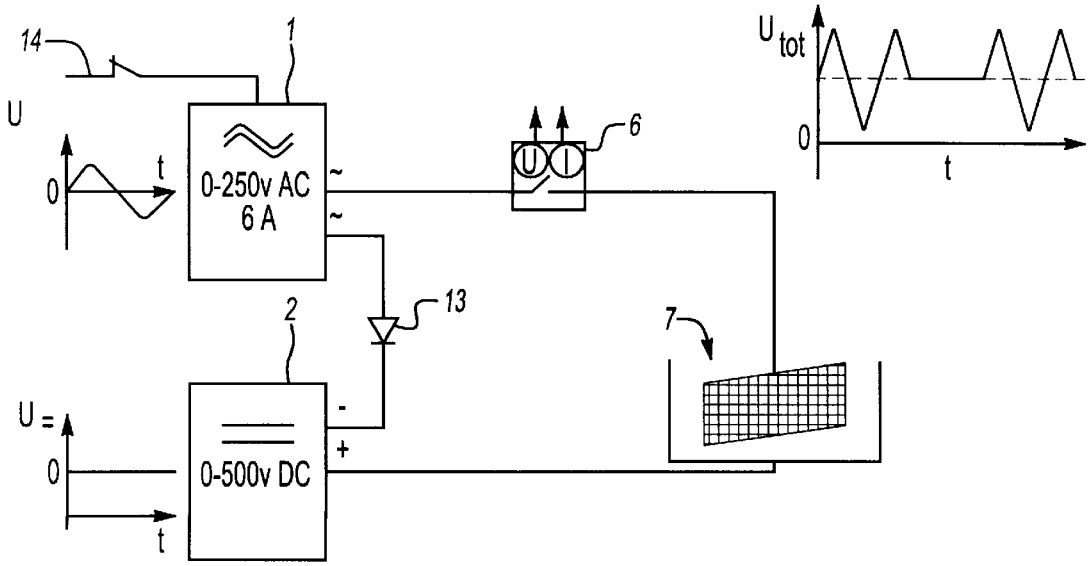
FIG. 4 is a schematic view of an apparatus for coating objects according to a fourth embodiment.

FIG. 4 shows a further variant of the apparatus according to the invention having a series circuit comprising a DC generator and an AC generator, in which series circuit the diode 13 has been added.

The rectifier circuit according to FIG. 1 has been used in the examples described in the following text. The maximum current level which can be achieved with the test layout was limited on average to 6 A by the variable transformer. The required current density was then reached by reducing the size of the active surface of the metal sheets to be coated.

Test Program for Examples 1 to 5

Coating of metal materials with various coatings (commercial products from BASF Lacke und Farben AG)
Qualities:

| | |
|---|---|
| FT 85-7042 | CATHODIP ® |
| FT 82-7627 | CATHOGUARD ® |
| FT 82-7640 | CATHOGUARD 350 ® |
| FT 25-7225 | CATHOGUARD 100B ® |

Deposition conditions:
DC voltage: range of voltages up to breakdown in 20 V steps
Voltage pulses:

Example 1: Two 10 ms pulse half-cycles at 20 ms (equivalent to 100 Hz)

Example 2: One 10 ms pulse half-cycle at 20 ms (equivalent to 50 Kz) Switch positions a)+b) at 0, 30, 60, 150, 250 V Example 3: One pulse half-cycle; 10 s pulsed voltage, 110 s DC voltage (Pulses: 60, 150, 250 V)

Example 4: One pulse half-cycle; 10 s DC voltage, 110 s pulsed voltage (Pulses: 60, 150, 250 V)

Example 5: One pulse half-cycle; 60 s DC voltage, 60 s pulsed voltage (Pulses: 60, 150, 250 V)

Evaluation: breakdown voltage, film thickness SD
Test results:

EXAMPLE 1

Figure 9:
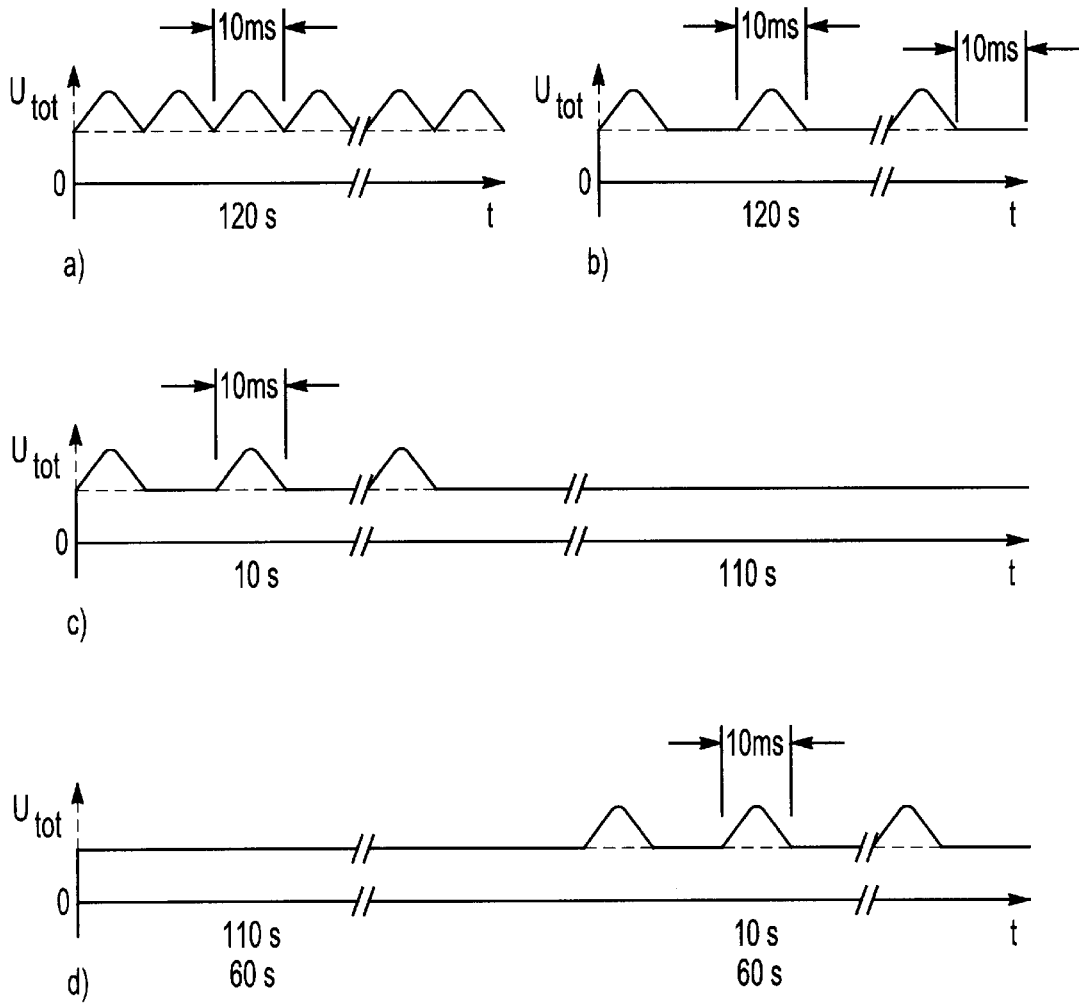
FIG. 9 illustrates the pulse modulation utilized in each of the first through fifth examples.

Pulse modulation with two pulse half-cycles is set (frequency equivalent to 100 Hz, cf. Diagram a) in FIG. 9).

Figure 5:
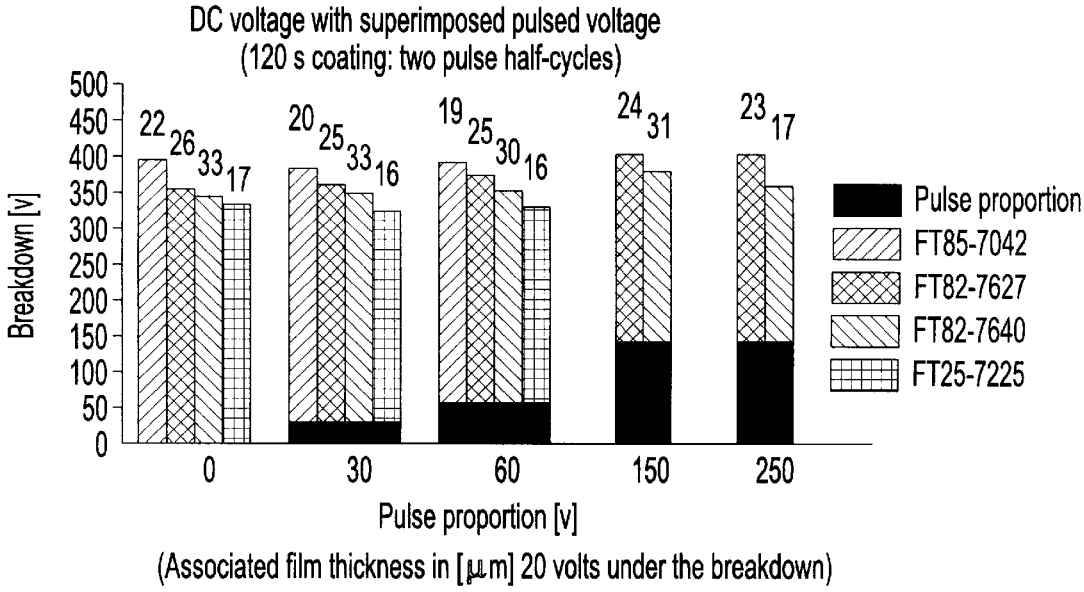
FIG. 5 is a histogram (with a breakdown voltage plotted against a pulse proportion voltage) illustrating the results of a first example test.

The results are shown in FIG. 5 and Tables 1 and 2 (Column 1). Up to a level of 60 V, the breakdown voltage is governed by the peak voltage reached. In some cases, the pulsed element was increased to 250 V. This allowed peak voltages to be achieved, some of which were 40–50 V above those of pure DC deposition.

EXAMPLE 2

Figure 6:
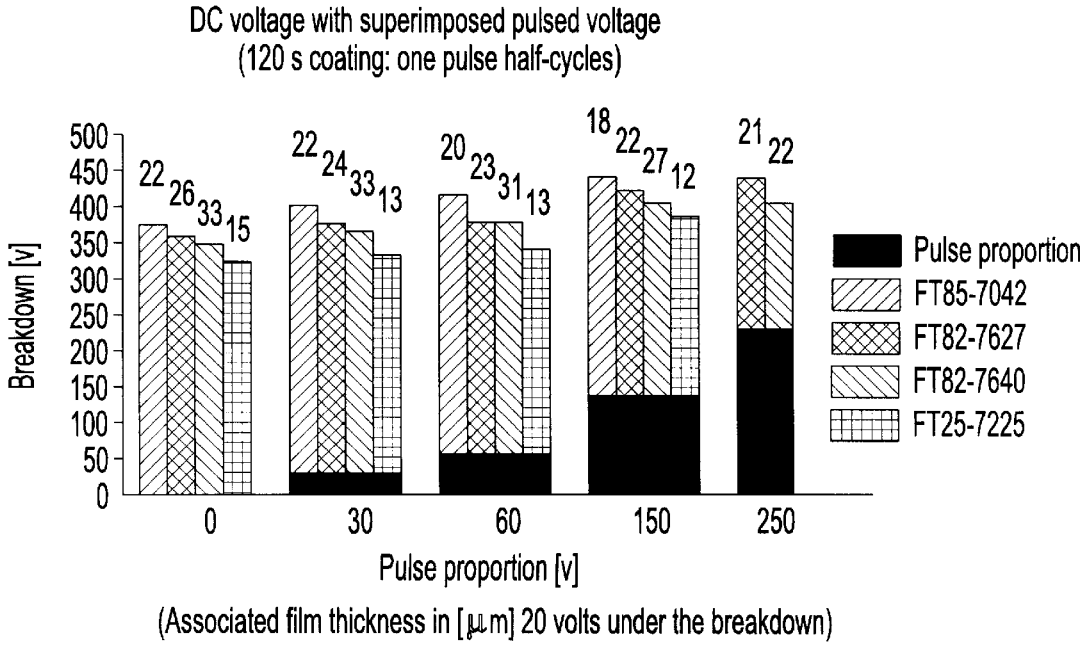
FIG. 6 is a histogram (with a breakdown voltage plotted against a pulse proportion voltage) illustrating the results of a second example test.

Pulse modulation with one pulse half-cycle was set (frequency equivalent to 50 Hz, cf. Diagram b) in FIG. 9). The results are shown in FIG. 6 and Tables 1 and 2 (Column 2). Considerably higher peak voltages were possible with all products by reducing the pulse repetition rate. This effect started even with voltage pulses of 30 V, and increased as the pulse level rose. With voltage pulses of 150–250 V, the difference between the breakdown voltage of DC deposition and the possible voltage peaks rose to values of 70–80 V. The film thickness at 20 V below the breakdown voltage decreased as the pulse proportion increased.

EXAMPLE 3

Figure 7:
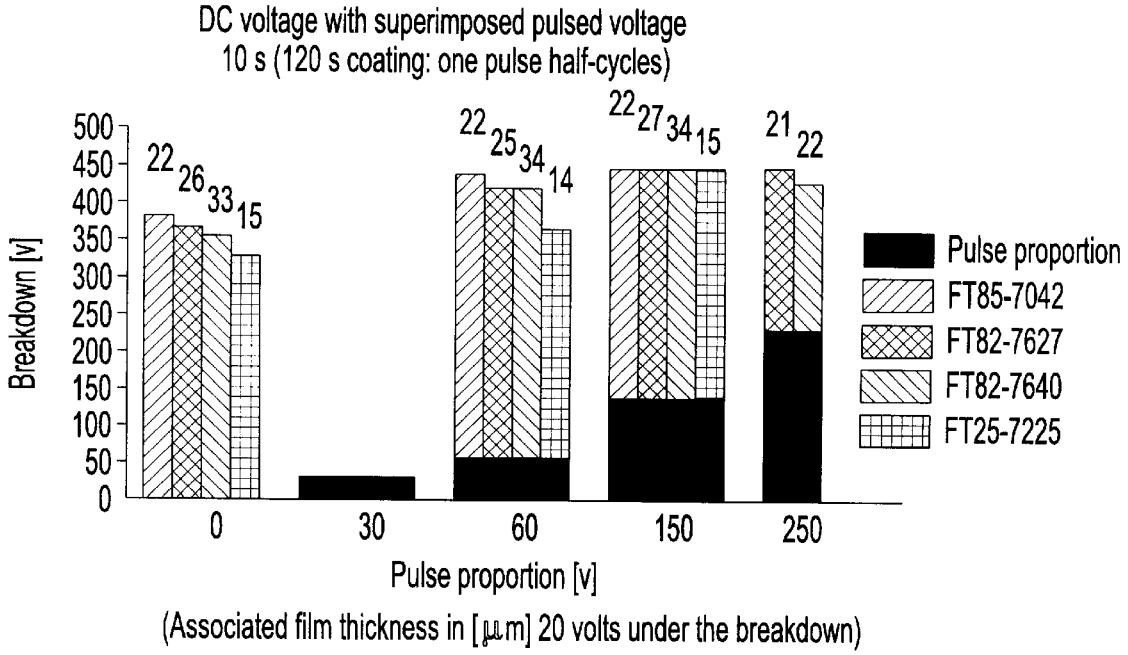
FIG. 7 is a histogram (with a breakdown voltage plotted against a pulse proportion voltage) illustrating the results of a third example test.

Coating operations were carried out with a 10 s pulse-modulated DC voltage (equivalent to 50 Hz), followed by 110 s of pure DC voltage (Diagram C) in FIG. 9). The results are shown in FIG. 7 and Tables 1 and 2 (Column 3) and are similar to those from Example 2, in which the DC voltage had voltage pulses superimposed on it throughout the entire coating process.

EXAMPLE 4

Coating was carried out with 10 s DC voltage and then 110 s DC voltage with a superimposed pulsed voltage (equivalent to 50 Hz) (Diagram d) in FIG. 9). The corresponding results can be found in Tables 1 and 2 (Column 4). In contrast to Example 3, the voltage pulses in this case were therefore not applied until after a coating time of 10 s. This variation allowed a further increase in the peak voltage to be achieved. With FT 82-7627, this effect resulted in improvements of a maximum of 20 V; with FT 82-7640, 20–40 V higher voltage peaks occurred. The most significant change was with FT 25-7225, with voltage increases of up to 60 V.

EXAMPLE 5

60 s DC voltage and 60 s DC voltage with superimposed pulse voltage were set (Diagram d) in FIG. 9). The results were identical to Example 4 (cf. Column 5 in Tables 1 and 2).

EXAMPLE 6

Figure 8:
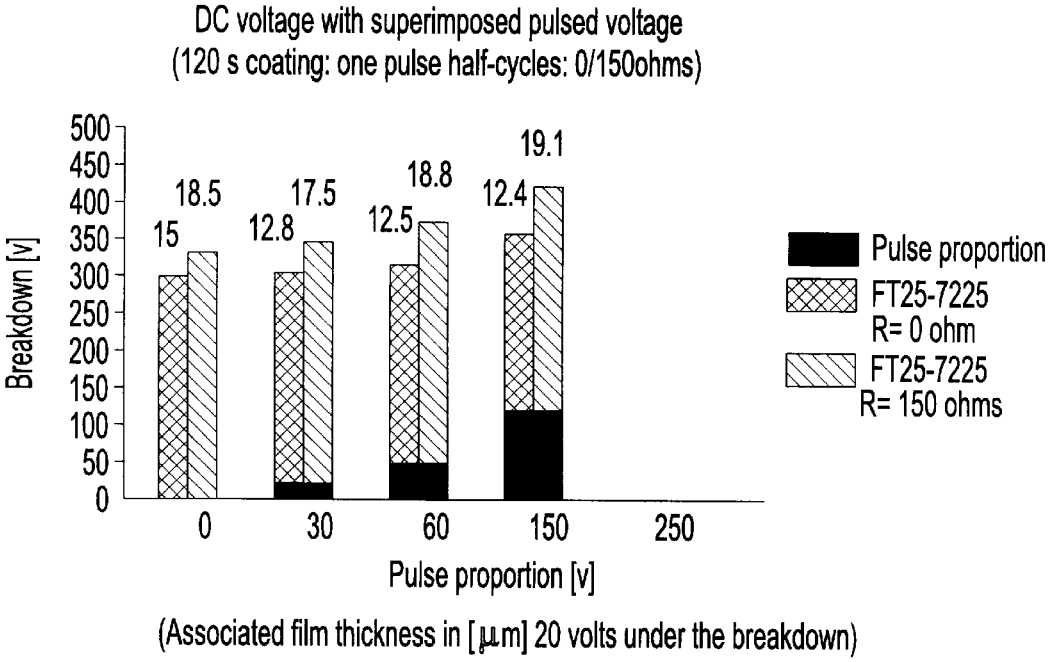
FIG. 8 is a histogram (with a breakdown voltage plotted against a pulse proportion voltage) illustrating the results of a sixth example test.

A bias resistor was integrated in the test layout. The results are shown in FIG. 8. When the bias resistor was used, the reduction in the film thickness which was otherwise observed as the pulsed voltage amplitude was increased up to 150 V was no longer evident. Tables 3 and 4 show the data associated with FIG. 8.

Result of Examples 1 to 6

The film thicknesses achieved at 20 V below the breakdown voltage are noted on the respective bars in all the graphs. It can be seen from this that, with the exception of the test conditions for Example 6, the achievable film thickness is reduced as the pulse level increases. This effect amounts to a few $\mu$m up to a pulse level of 150 V. The relevant film thicknesses are summarized in Table 2.

On the basis of the results shown above, the novel process is distinguished by the following advantages:

1. The sum voltage can be increased considerably above the breakdown voltage of conventional processes before any breakdown occurs.
2. The voltage which must be applied to achieve a specific film thickness can be varied over a wide range by the process according to the invention, by setting the ratio of the pulsed voltage element and the DC voltage element.

TABLE 1

| | Influence of the AC voltage element on the breakdown voltage | | | | |
|---|---|---|---|---|---|
| | 100 Hz | 50 Hz | 50 Hz 10 s pulse + 110 s DC | 50 Hz 10 s DC + 110 s pulse | 50 Hz 60 s DC + 60 s pulse |
| FT 85-7082 | | | | | |
| DC voltage | 400 volts | 380 V | 380 V | 380 V | 380 V |
| DC + 30 V AC | 360–390 V | 380–410 V | | | |
| DC + 60 V AC | 340–400 V | 360–420 V | 360–420 V | 380–440 V | 380–440 V |
| DC + 150 V AC | | 300–450 V | 300–450 V | 300–450 V | 320–470 V |
| DC + 250 V AC | | | | | |
| FT 82-7627 | | | | | |
| DC voltage | 360 V | 360 V | 360 V | 360 V | 360 V |
| DC + 30 V AC | 340–370 V | 350–380 V | | | |
| DC + 60 V AC | 320–380 V | 320–400 V | 340–400 V | 360–420 V | 360–420 V |
| DC + 150 V AC | 260–410 V | 280–430 V | 260–410 V | 300–450 V | 300–450 V |
| DC + 250 V AC | 160–410 V | 200–450 V | 200–450 V | 200–450 V | 200–450 V |
| FT 82-7640 | | | | | |
| DC voltage | 350 V | 350 V | 350 V | 350 V | 350 V |
| DC + 30 V AC | 330–360 V | 340–370 V | | | |
| DC + 60 V AC | 300–360 V | 320–380 V | 310–370 V | 360–420 V | 350–410 V |
| DC + 150 V AC | 240–390 V | 260–410 V | 240–390 V | 300–450 V | 300–450 V |
| DC + 250 V AC | 120–370 V | 160–410 V | | 180–430 V | 180–430 V |

TABLE 1-continued

| | Influence of the AC voltage element on the breakdown voltage | | | | |
|---|---|---|---|---|---|
| | 100 Hz | 50 Hz | 50 Hz 10 s pulse + 110 s DC | 50 Hz 10 s DC + 110 s pulse | 50 Hz 60 s DC + 60 s pulse |
| FT 25-7225 | | | | | |
| DC | 340 V | 320 V | 320 V | 320 V | 320 V |
| DC + 30 V AC | 300–330 V | 300–330 V | | | |
| DC + 60 V AC | 280–340 V | 280–340 V | 280–340 V | 300–360 V | 300–360 V |
| DC + 150 V AC | | 240–390 V | 260–410 V | 300–450 V | 300–450 V |
| DC + 250 V AC | | | | | |

TABLE 2

| | Film thickness SD which is achieved 20 V below the breakdown voltage (Variation of the DC voltage and AC voltage element) | | | | |
|---|---|---|---|---|---|
| | 100 Hz | 50 Hz | 50 Hz 10 s pulse + 110 s DC | 50 Hz 10 s DC + 110 s pulse | 50 Hz 60 s DC + 60 s pulse |
| FT 85-7042 | | | | | |
| DC voltage | 22 μm | 22 μm | 22 μm | 22 μm | 22 μm |
| DC + 30 V AC | 20 μm | 22 μm | | | |
| DC + 60 V AC | 19 μm | 20 μm | 19 μm | 22 μm | 22 μm |
| DC + 150 V AC | | 18 μm | 16 μm | 22 μm | 19 μm |
| DC + 250 V AC | | | | | |
| FT 82-7627 | | | | | |
| DC voltage | 26 μm | 26 μm | 26 μm | 26 μm | 26 μm |
| DC + 30 V AC | 25 μm | 24 μm | | | |
| DC + 60 V AC | 25 μm | 23 μm | 25 μm | 25 μm | 25 μm |
| DC + 150 V AC | 24 μm | 22 μm | 23 μm | 27 μm | 25 μm |
| DC + 250 V AC | 23 μm | 21 μm | 16 μm | 21 μm | 17 μm |
| FT 82-7640 | | | | | |
| DC voltage | 33 μm | 33 μm | 33 μm | 33 μm | 33 μm |
| DC + 30 V AC | 33 μm | 33 μm | | | |
| DC + 60 V AC | 30 μm | 31 μm | 28 μm | 34 μm | 33 μm |
| DC + 150 V AC | 31 μm | 27 μm | 22 μm | 34 μm | 27 μm |
| DC + 250 V AC | 17 μm | 22 μm | | 22 μm | 19 μm |
| FT 25-7225 | | | | | |
| DC | 17 μm | 15 μm | 15 μm | 15 μm | 15 μm |
| DC + 30 V AC | 16 μm | 13 μm | | | |
| DC + 60 V AC | 16 μm | 13 μm | 13 μm | 14 μm | 13 μm |
| DC + 150 V AC | | 12 μm | 11 μm | 15 μm | 13 μm |
| DC + 250 V AC | | | | | |

TABLE 3

| | FP 224/93 Residual ripple FT-25-7225 without $R_v$ Table entries = film thickness in μm | | | | | | | | | |
|---|---|---|---|---|---|---|---|---|---|---|
| | | Extension of frequency | | | 10 s Start | | After 10 s | | After 60 s | |
| | — | 30 V | 60 V | 150 V | 60 V | 150 V | 60 V | 150 V | 60 V | 150 [lacuna] |
| 200 V | | | | 10.7 ± 0.4 | | | | | | |
| 220 V | | | | 12.4 ± 0.8 | | 9.9 ± 0.8 | | | | |
| 240 V | 10.3 ± 0.4 | | | 35 ± 19.8 | | 10.6 ± 0.6 | | 13.0 ± 0.4 | | |
| 260 V | 11.4 ± 0.2 | 10.1 ± 0.3 | 12.5 ± 0.6 | | | | 11.9 ± 0.4 | 14.4 ± 0.6 | 10.9 ± 0.2 | 11.9 ± 0.5 |
| 280 V | 14.3 ± 0.4 | 12.8 ± 1.1 | 27.6 ± 1–3.2 | | 26.6 ± 10.8 | | 14.0 ± 0.6 | 15.2 ± 0.7 | 12.5 ± 0.6 | 13.6 ± 0.9 |
| 300 V | 14.0 ± 0.4 | 40.7 ± 2.5 | | | | | 51.7 ± 11 | | 28.1 ± 10.4 | |

TABLE 4

FP 224/93 Residual ripple FT-25-7225 $R_v$ = 150 Ω
Table entries = film thickness in μm

| | — | Extension of frequency | | | 10 s Start | | After 10 s | | After 60 s | |
|---|---|---|---|---|---|---|---|---|---|---|
| | | 30 V | 60 V | 150 V | 60 V | 150 V | 60 V | 150 V | 60 V | 150 V |
| Voltage (breakdown voltage - 20) | | | | | | | | | | |
| 240 V | | | | 14.8 ± 0.2 | | | | | | |
| 260 V | | | | 16.7 ± 0.7 | | 13.0 ± 0.5 | | 15.3 ± 0.5 | | 13.1 ± 0.4 |
| 280 V | | | | 18.0 ± 0.7 | | 14.4 ± 0.7 | | 16.4 ± 0.7 | | 14.5 ± 0.5 |
| 300 V | 15.5 ± 0.5 | 16.5 ± 0.6 | 16.8 ± 1.1 | 19.1 ± 0.7 | 15.3 ± 0.5 | 17.1 ± 0.7 | 17.7 ± 0.7 | 18.4 ± 1.0 | 15.6 ± 0.5 | 17.0 ± 0.6 |
| 320 V | 16.9 ± 0.7 | 17.5 ± 0.7 | 18.8 ± 0.9 | | 17.3 ± 0.5 | 22.5 ± 6.6 | 17.4 ± 0.6 | | 16.8 ± 0.4 | 18.7 ± 0.7 |
| 340 V | 18.5 ± 2.0 | 31.4 ± 4.6 | 19.8 ± 1.6 | | 20.6 ± 5.7 | | 19.3 ± 2.0 | | 18.4 ± 1.1 | |
| 360 V | 26.4 ± 1–1.2 break-down | | | | | | | | | |

What is claimed is:

1. A method for electrochemical coating of objects with a resinous coating material comprising the steps of:

applying a direct current to a bath of a cationic resinous coating material;

pulse-modulating a DC voltage of said direct current by superimposing thereon an adjustable AC voltage component, wherein the pulse-modulation of the DC voltage is connected and disconnected with an adjustable duty ratio; and coating an object with the coating material while applying said direct current, wherein the resulting superimposed voltage does not change its direction and pulse-modulation of the DC voltage is limited to certain time intervals during the coating process.

2. The method according to claim 1, wherein said AC voltage components is obtained from a cyclic AC voltage.

3. The method according to claim 2, wherein said AC voltage component is are selected from the group consisting of the complete cycle signal, its positive element, and the cycle signal after being rectified.

4. The method according to claim 2, wherein the cyclic AC voltage has a cycle duration of 1 ms to 500 ms.

5. A method according to claim 2, wherein the cyclic AC voltage is a harmonic oscillation.

6. The method according to claim 1, wherein the DC voltage element is between 0 and 500 V.

7. The method according to claim 1, wherein the AC voltage element is between 0 and 550 V.

8. A method according to claim 1, wherein the coating material is cross-linkable.

9. A method for eletrochemical coating of objects with a resinous coating material comprising the steps of;

applying a direct current to a bath of resinous coating material;

pulse-modulating a DC voltage of said direct current by superimposing thereon an adjustable AC voltage component; and coating an object with the coating material while applying said direct current, wherein the resulting superimposed voltage does not change its direction and pulse-modulation of the DC voltage is limited to certain time intervals during the coating process, wherein the pulse modulation of the DC voltage is connected and disconnected with an adjustable duty ratio between 10:1 and 1:10, a connection duration being between 10 ms and 100 s.

10. An apparatus for coating objects using a pulse-modulated DC current signal comprising:

a bath of an electro-dipping resinous coating material;

a DC generator for producing a DC current signal that is applied to the electro-dipping bath of resinous coating material;

an AC generator for producing an AC signal; and an automatic control circuit for selectively superimposing said AC signal onto said DC signal during limited time intervals of the coating process in which the AC generator is connected to and disconnected from the DC generator with an adjustable duty ratio.

11. The apparatus according to claim 10 wherein said control circuit includes a switching device for selectively connecting and disconnecting said AC generator to said DC generator.

12. The apparatus according to claim 11, wherein said control circuit further includes a function generator that acts on said switching device in order to produce said pulse modulated DC current signal.

13. The apparatus according to claim 12, wherein said function generator comprises a programmable microprocessor.

* * * * *